US007755600B2

(12) United States Patent
Nihei et al.

(10) Patent No.: US 7,755,600 B2
(45) Date of Patent: Jul. 13, 2010

(54) METHOD FOR DRIVING INFORMATION DISPLAY DEVICE AND INFORMATION DISPLAY DEVICE USING THE METHOD

(75) Inventors: Norio Nihei, Kodaira (JP); Shuhei Tsuchie, Itabashi (JP)

(73) Assignee: Bridgestone Corporation, Tokyo (JP)

( * ) Notice: Subject to any disclaimer, the term of this patent is extended or adjusted under 35 U.S.C. 154(b) by 867 days.

(21) Appl. No.: 11/587,183

(22) PCT Filed: Apr. 19, 2005

(86) PCT No.: PCT/JP2005/007435

§ 371 (c)(1),
(2), (4) Date: Oct. 23, 2006

(87) PCT Pub. No.: WO2005/104077

PCT Pub. Date: Nov. 3, 2005

(65) Prior Publication Data

US 2007/0211020 A1 Sep. 13, 2007

(30) Foreign Application Priority Data

Apr. 21, 2004 (JP) ..... 2004-125828
Apr. 21, 2004 (JP) ..... 2004-126013

(51) Int. Cl.
*G09G 3/34* (2006.01)

(52) U.S. Cl. ..... 345/107

(58) Field of Classification Search ..... 345/100–107
See application file for complete search history.

(56) References Cited

U.S. PATENT DOCUMENTS 6,239,896 B1 * 5/2001 Ikeda ..... 359/240
6,806,995 B2 * 10/2004 Chung et al. ..... 359/296
2002/0190936 A1 * 12/2002 Darty ..... 345/85

(Continued)

FOREIGN PATENT DOCUMENTS

JP 51-41992 A 4/1976

(Continued)

OTHER PUBLICATIONS

Supplementary European Search Report dated Jul. 2, 2008.

*Primary Examiner*—Richard Hjerpe
*Assistant Examiner*—Carolyn R Edwards
(74) *Attorney, Agent, or Firm*—Sughrue Mion, PLLC

(57) ABSTRACT

In an information display device according to the first to third inventions of the present invention, when a particle movement type information display device of passive matrix drive and dynamic drive is driven, the particle movement type information display device configured to be driven by using a drive circuit having an output stage equivalent circuit capable of outputting only two values of a predetermined drive voltage value and ground level (0V). Moreover, in the forth and fifth inventions of the present invention, in the method for driving the information display device, wherein the display media are sealed between two opposed substrates, at least one of which is transparent, and wherein the display media, to which an electrostatic field is applied, are made to move so as to display information such as an image or the like, electrodes of the information display device are connected to predetermined potential in the driving voltage range with low impedance while information refresh (scan) is not performed.

3 Claims, 10 Drawing Sheets

U.S. PATENT DOCUMENTS

| | | | | |
|---|---|---|---|---|
| 2003/0063076 | A1* | 4/2003 | Machida et al. | 345/204 |
| 2003/0085858 | A1* | 5/2003 | Okafuji et al. | 345/87 |
| 2003/0086455 | A1* | 5/2003 | Ciubotaru et al. | 372/38.02 |

FOREIGN PATENT DOCUMENTS

| | | | |
|---|---|---|---|
| JP | 52-70791 | A | 6/1977 |
| JP | 2003-315848 | A | 11/2003 |
| JP | 2004-4483 | A | 1/2004 |
| JP | 2004-163566 | A | 6/2004 |
| JP | 2005-10567 | A | 1/2005 |
| WO | 03/038512 | A1 | 5/2003 |

* cited by examiner

METHOD FOR DRIVING INFORMATION DISPLAY DEVICE AND INFORMATION DISPLAY DEVICE USING THE METHOD

TECHNICAL FIELD

The present invention relates to a method for driving an information display device, in which a particle movement type information display device of passive matrix drive and dynamic drive is driven, and to the information display device capable of driving the particle movement type information display device of passive matrix drive and dynamic drive by means of the above-mentioned driving method (the first to third inventions).

In addition, the present invention also relates to a method for driving an information display device, wherein the display media are sealed between two opposed substrates, at least one of which is transparent, and wherein the display media, to which an electrostatic field is applied, are made to move so as to display information such as an image or the like, and to the information display device using the above-mentioned method (the forth and fifth inventions).

BACKGROUND ART

As an information display device substitutable for liquid crystal display (LCD), information display devices with the use of technology such as an electrophoresis method, an electro-chromic method, a thermal method, dichroic-particles-rotary method have been proposed.

These conventional techniques are considered to be useful for inexpensive visual display devices of the next generation compared with a LCD due to merits such as wider field of vision close to normal printed matter, smaller power consumption or a memory function, and expected to be spread out to information displays for portable devices, electronic paper and the like. Recently, electrophoresis method for microencapsulating dispersion liquid made up with dispersion particles and coloration solution and disposing the liquid between opposed substrates, is proposed and expected.

However, in the electrophoresis method, there is a problem that a response rate is slow by the reason of viscosity resistance because the particles migrate among the electrophoresis solution. Further, there is a problem of lacking imaging repetition stability, because particles with high specific gravity of titanium oxide is scattered within solution of low specific gravity and it is difficult to maintain a stability of dispersion state. Even in the case of microencapsulating, the cell size is diminished to a microcapsule level in order to make it hard to show the above-mentioned drawbacks, however, an essential problem is not overcome at all.

Besides the electrophoresis method using behavior in the solution, recently, a method that electro-conductive particles and a charge transport layer are installed in a part of the substrate without using solution has been proposed. [The Imaging Society of Japan "Japan Hardcopy '99" (Jul. 21-23, 1999) Transaction Pages 249-252] However, the structure becomes complicated because the charge transport layer and further a charge generation layer are to be arranged. In addition, it is difficult to constantly charge the electro-conductive particles, and thus there is a drawback on the lack of stability.

As one method for overcoming the various problems mentioned above, an information display device comprising an information display panel is known, wherein the display media (particles or liquid powders) are sealed between a front substrate provided with a front electrode and a back substrate provided with a back electrode, and wherein the display media, to which an electrostatic field is applied, are made to move by means of Coulomb's force so as to display information such as an image or the like.

(Objects of the First to Third Inventions)

A drive circuit used to drive an information display panel in an information display device by passive matrix drive or dynamic drive is required to have a drive integrated circuit enable to output polarity drive voltages respectively to the row and column and a drive integrated circuit enable to output multi-valued drive voltages respectively to the row and column. However such a drive integrated circuit having a function of outputting more than one kind of voltages costs high so as to cause an increase in cost.

In addition, it is possible to use a drive integrated circuit with high withstand voltage instead of a drive integrated circuit having a function of outputting polarity drive voltages. However such a drive integrated circuit with high withstand voltage costs high so as to cause an increase in cost.

(Objects of the Forth and Fifth Inventions)

FIG. 10 is a block diagram showing an example of a method for driving a conventional information display device. In the example shown in FIG. 10, in a display panel 51 panel driving voltage is applied to a terminal 52 of the row direction by a row driver 61 while panel driving voltage is applied to a terminal 53 of the column direction by a column driver 71. The output stage of the row driver 61 has CMOS structure with two FETs 62-1 and 62-2, while the output stage of the column driver 71 has CMOS structure with two FETs 72-2 and 72-2.

In the conventional display panel 51 shown in FIG. 10, every time display image is changed, panel driving voltage is scanned along the row direction to rewrite information of an image or the like. When display image is not changed, as shown in FIG. 10 two FETs 62-1 and 62-2 of the row driver 61 and two FETs 72-1 and 72-2 of the column driver 71 are kept open state in power-off state. Therefore, the terminal 52 of the row direction and the terminal 53 of the column direction are all OPEN (high impedance) state to stay ready to next rewriting.

The above-mentioned information display device having display memory property usually does not rewrite (scan) the information until the display information is changed (although there are some other ways to rewrite the information by regular refresh of the information). In this case, if the information is distorted by electrostatic discharge etc, the defect state would be kept for a long time even though the defect is recovered by the next refresh (scan) of the display information. In addition, many of the information display devices selling ultra low power consumption have display memory function and is high impedance, therefore, the information such as image etc is easily distorted by tiny energy such as electrostatic discharge etc.

DISCLOSURE OF INVENTION

An object of the first and second inventions of the present invention is to provide a method for driving an information display device, wherein the driving voltage is reviewed, a drive circuit arranged with an inexpensive drive integrated circuit is used and cost reduction of the information display device is achieved.

An object of the third invention of the present invention is to provide a cost reduced information display device by adopting above-mentioned method for driving the information display device.

An object of the forth and fifth inventions of the present invention is to eliminate the drawbacks mentioned above, to provide a method for driving an information display device, in which distortion of display information does not occur during information retention period when information is not refreshed (scanned), and to provide the information display device using the method.

The method for driving an information display device according to the first invention of the present invention is the method for driving a particle movement type information display device of passive matrix drive and dynamic drive, characterized in that the particle movement type information display device is driven by means of a drive circuit having an output stage equivalent circuit capable of outputting only two values of a predetermined driving voltage value and ground level.

In the method for driving the information display device of the first invention, it is preferable that a switching operation of writing first display information and second display information is performed by switching driving voltage of either row or column which is not scanned.

The method for driving the information display device according to the second invention of the present invention is the method for driving a particle movement type information display device of passive matrix drive and dynamic drive, characterized in that the particle movement type information display device is driven by means of a drive circuit in which ground level of an output analog circuit can be set independent of ground level of an input digital circuit.

In the method for driving the information display device according to the second invention, it is preferable that the drive circuit comprises a drive integrated circuit of triple-well structure or the drive circuit comprises a floating circuit.

In addition, the information display device according to the third invention of the present invention is characterized in that by means of the methods for driving the information display device according to the first and second invention, the particle movement type information display device of passive matrix drive and dynamic drive is driven.

According to the method for driving the information display device of the first invention of the above configuration, when the particle movement type information display device of passive matrix drive and dynamic drive is driven, it is driven by means of a drive circuit having an output stage equivalent circuit capable of outputting only two values of a predetermined driving voltage value and ground level, so that an inexpensive drive circuit using an inexpensive drive circuit for controlling the row and column can be used, which is capable of outputting only two values of the predetermined driving voltage value and ground level, instead of an expensive drive integrated circuit having a function of outputting multi-valued voltages. Therefore, cost reduction of the information display device may be possible.

According to the method for driving the information display device of the second invention of the above configuration, when the particle movement type information display device of passive matrix drive and dynamic drive is driven, it is driven by means of a drive circuit in which ground level of an output analog circuit can be set independent of ground level of an input digital circuit, so that an inexpensive drive circuit using an inexpensive drive circuit for controlling the row and column can be used, which has output stage of general C-MOS structure capable of outputting only unipolarity voltage instead of a drive integrated circuit capable of outputting polarity voltages. Therefore, cost reduction of the information display device may be possible.

According to the information display device of the third invention of the above configuration, it is possible to provide a cost reduced information display device since by means of the methods for driving the information display device according to the first and second inventions mentioned above, the particle movement type information display device of passive matrix drive and dynamic drive is driven.

The method for driving the information display device according to the forth invention of the present invention is the method for driving the information display device, wherein the display media are sealed between two opposed substrates, at least one of which is transparent, and wherein the display media, to which an electrostatic field is applied, are made to move so as to display information such as an image or the like, characterized in that electrodes of the information display device are connected to the predetermined potential in the driving voltage range with low impedance while information refresh (scan) is not performed.

As a preferred embodiment of the method for driving the information display device according to the forth invention of the present invention, a circuit for connecting electrodes to predetermined potential in a driving voltage range with low impedance is configured to function even in power-off state, and a body diode at source-to-drain in output stage C-MOS structure of driver is used to set panel driving power source to GND level in power-off state so that the electrodes are connected to GND potential with low impedance.

In addition, the information display device according to the fifth invention of the present invention is characterized in that the information display device is driven by mean of the method for driving the information display device according to the forth invention mentioned above.

According to the forth invention of the present invention, the electrodes of the information display device are connected to the predetermined potential in the driving voltage range, preferable to GND level with low impedance while information is not refreshed (scanned), so that the information will not be disturbed even by electrostatic discharge.

BEST MODE FOR CARRYING OUT THE INVENTION

Figure 1:
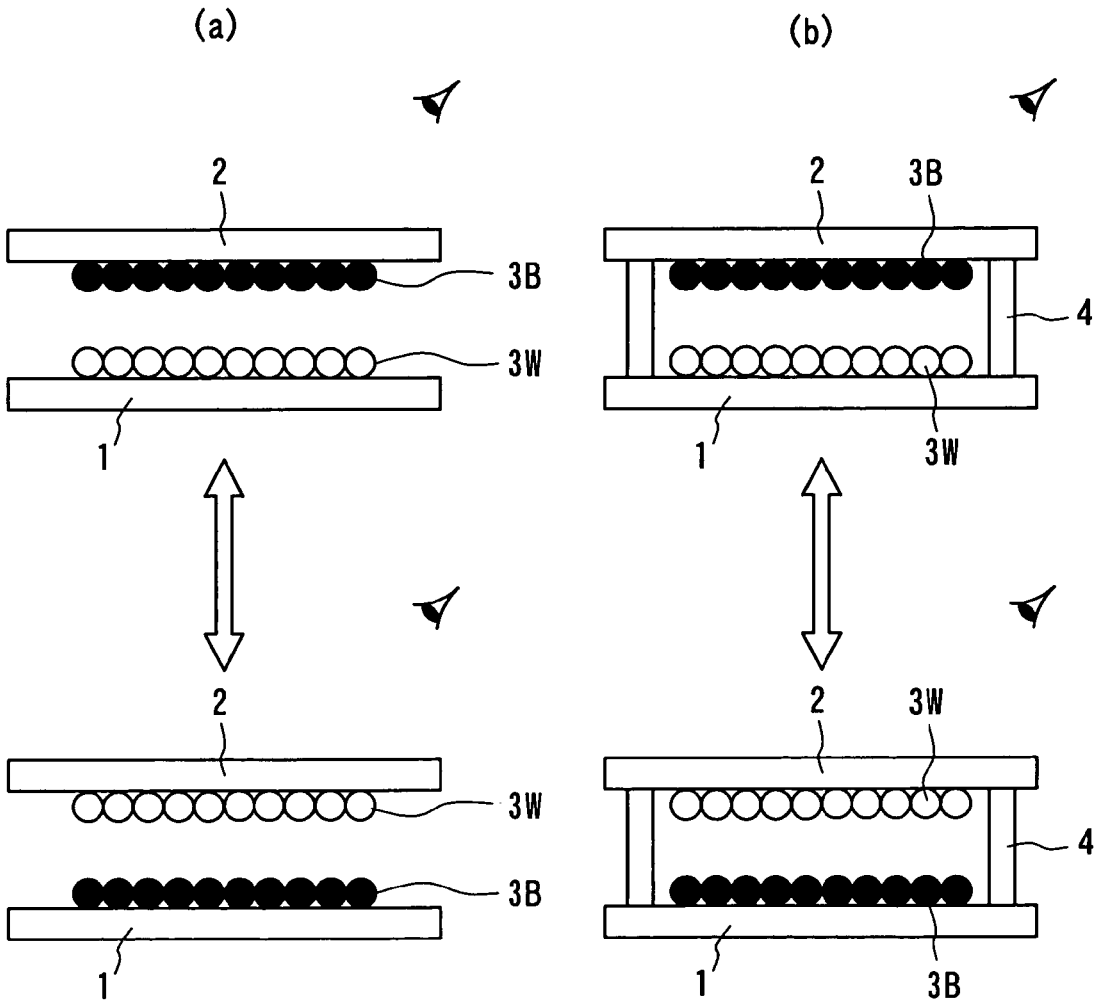
FIGS. 1*a* and 1*b* are schematic views respectively showing one example of the information display panel used in the information display device according to the invention.
Figure 2:
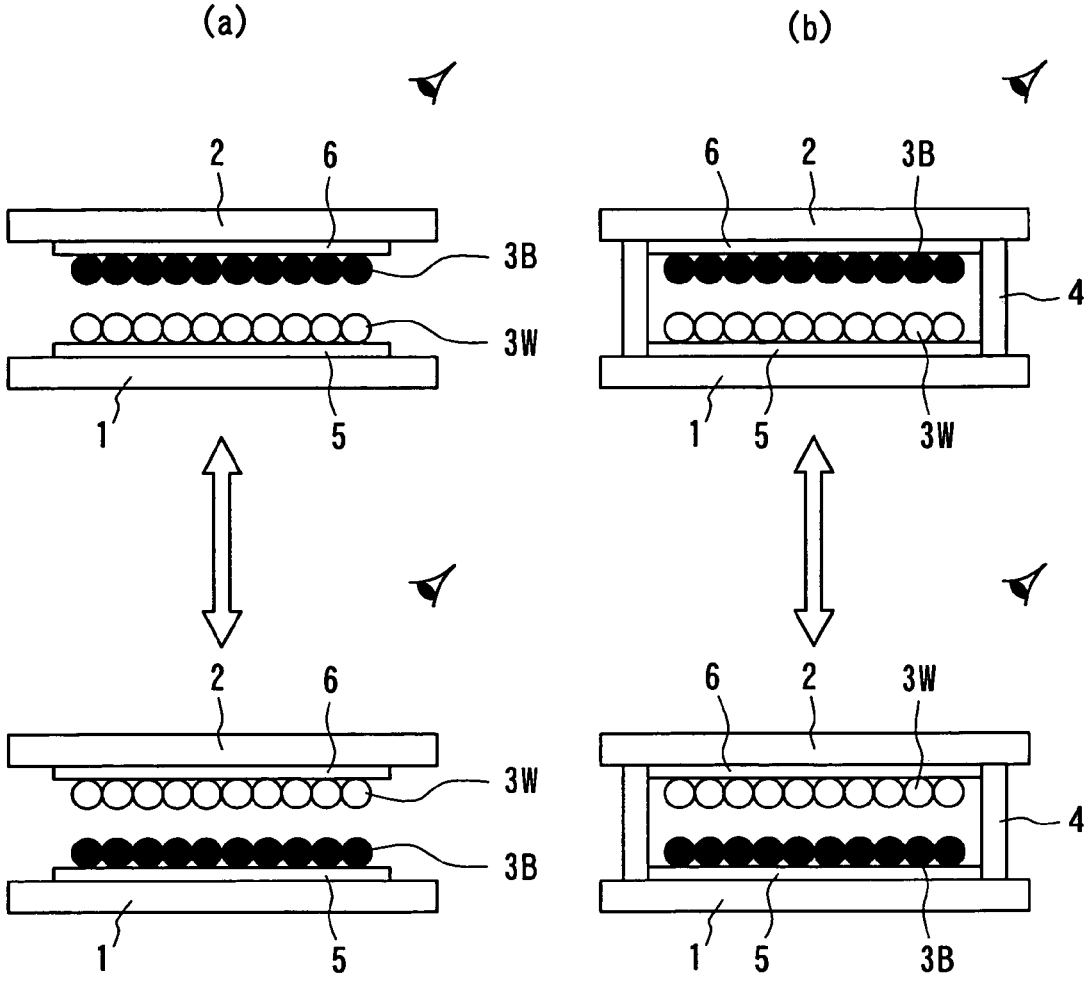
FIGS. 2*a* and 2*b* are schematic views respectively illustrating another example of the information display panel used in the information display device according to the invention.
Figure 3:
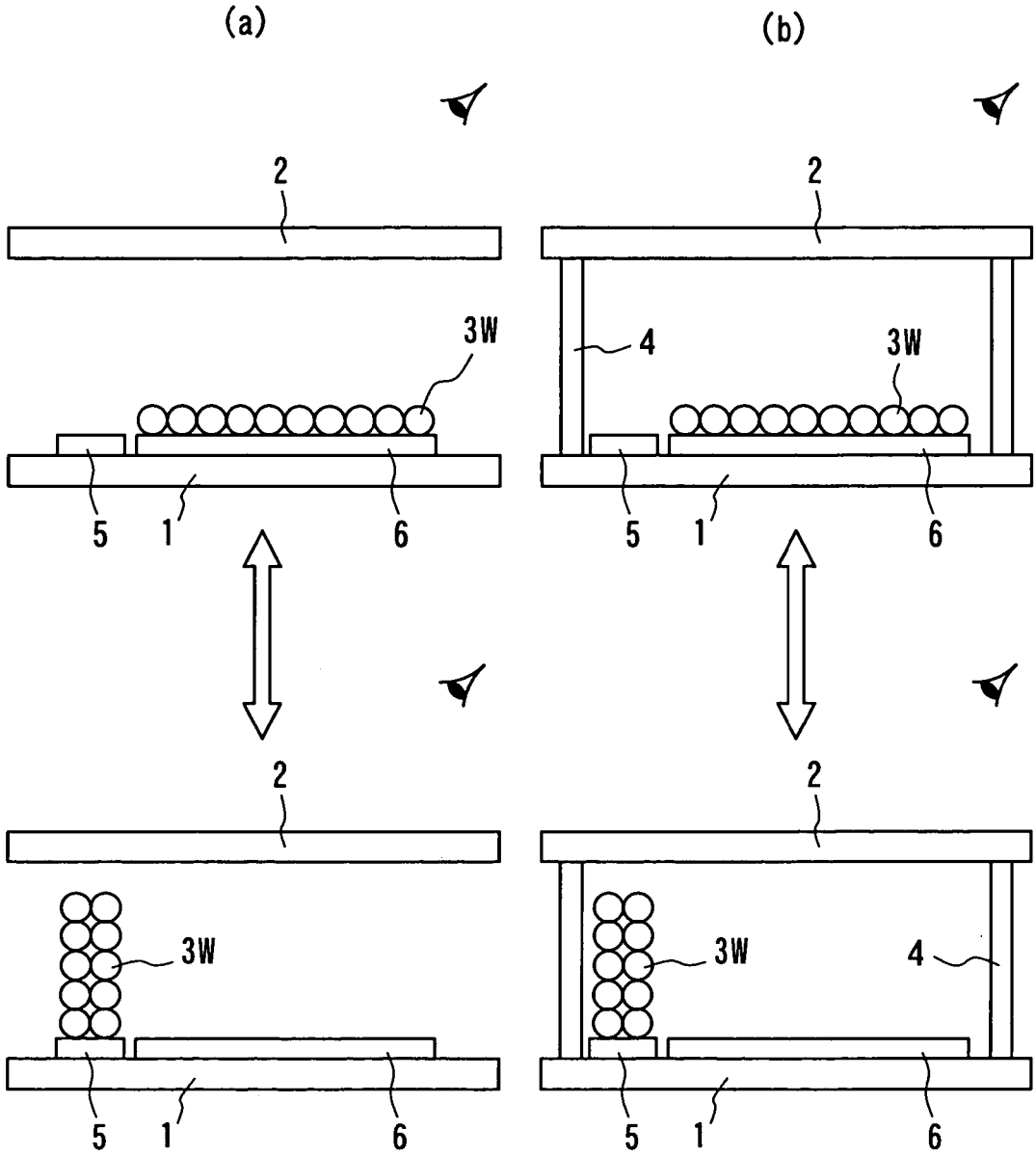
FIGS. 3*a* and 3*b* are schematic views respectively depicting still another example of the information display panel used in the information display device according to the invention.

At first, a basic construction of an information display panel using particles and constituted in an information display device of the present invention. In the information display panel used in the present invention, an electrostatic field is applied to particles sealed between two opposed substrates. Low-charged particles are attracted to the high-charged side and high-charged particles are attracted to the low-charged side along a direction of the applied electrostatic field by means of Coulomb's force, and thus the particles can be moved reciprocally by varying a direction of electrostatic field due to a switching operation of potential. Accordingly, an image can be displayed. Therefore, it is necessary to design the information display panel in such a manner that the particles can move evenly and maintain stability during a reciprocal operation or during a reserving state. Here, as to forces applied to the particles, there are an attraction force between the particles due to Coulomb's force, an imaging force with respect to the electrodes or substrates, an intermolecular force, a liquid bonding force, a gravity and the like.

One example of the information display panel used in the invention will be explained with reference to FIGS. 1*a* and 1*b*-FIGS. 3*a* and 3*b*.

In the examples shown in FIGS. 1*a* and 1*b*, at least two or more groups of image display media 3 having different optical reflectance and charging characteristics and consisting of at least one or more groups of particles (here, a white particle 3W consisting of particles and a black particle 3B consisting of particles are shown) are moved in a perpendicular direction with respect to substrates 1 and 2, in accordance with an electric field applied from electrodes (not shown) which are arranged outside of the substrates 1 and 2, so as to display a black color by viewing the black particle 3B to an observer or so as to display a white color by viewing the white particle 3W to the observer. In the example shown in FIG. 1*b*, for example grid-like partition walls 4 is provided between the substrates 1 and 2 to form a display cell, in addition to the example shown in FIG. 1*a*. Moreover, in FIG. 1*b*, the partition wall arranged at a near side is omitted.

In the examples shown in FIGS. 2*a* and 2*b*, at least two or more groups of image display media 3 having different optical reflectance and charging characteristics and consisting of at least one or more groups of particles (here, a white particle 3W consisting of particles and a black particle 3B consisting of particles are shown) are moved in a perpendicular direction with respect to substrates 1 and 2, in accordance with an electric field generated by applying a voltage between an electrode 5 provided with the substrate 1 and an electrode 6 provided with the substrate 2, so as to display a black color by viewing the black particle 3B to an observer or so as to display a white color by viewing the white particle 3W to the observer. In the example shown in FIG. 2*b*, for example grid-like partition walls 4 is provided between the substrates 1 and 2 to form a display cell, in addition to the example shown in FIG. 2*a*. Moreover, in FIG. 2*b*, the partition wall arranged at a near side is omitted.

In the examples shown in FIGS. 3*a* and 3*b*, at least two or more groups of image display media 3 having different optical reflectance and charging characteristics and consisting of at least one or more groups of particles (here a white particle 3W consisting of particles and a black particle 3B consisting of particles are shown) are moved in a perpendicular direction with respect to substrates 1 and 2, in accordance with an electric field generated by applying a voltage between the electrode 5 provided with the substrate 1 and the electrode 6 provided with the substrate 2, so as to display a white color by viewing the white particle 3W to an observer or so as to display a color of the electrode 6 or the substrate 1 by viewing a color of the electrode 6 or the substrate 1 to the observer. In the example shown in FIG. 3*b*, for example grid-like partition walls 4 is provided between the substrates 1 and 2 to form a display cell, in addition to the example shown in FIG. 3*a*. Moreover, in FIG. 3*b*, the partition wall arranged at a near side is omitted.

The above explanations can be applied to a case such that the white particles 3W consisting of particles are substituted by white liquid powders or a case such that the black particles 3B consisting of particles are substituted by black liquid powders.

(Explanation of the First to Third Inventions)

One example of the method for driving an information display device according to the invention will be explained based on FIGS. 4*a* to 4*e* in comparison with the prior art. In FIGS. 4*a* to 4*e*, information display panels in which information display elements (pixels) are arranged in 3×3 matrix state, are schematically shown for convenience of explanation. However electrodes of each rows and columns to apply driving voltage to each pixel are not shown. In the following, examples that the method for driving an information display device according to the present invention is applied to a particle movement type information display device of passive matrix drive are shown. However, it is also possible to apply the method to a particle movement type information display device of dynamic drive (segment panel).

Figure 4:
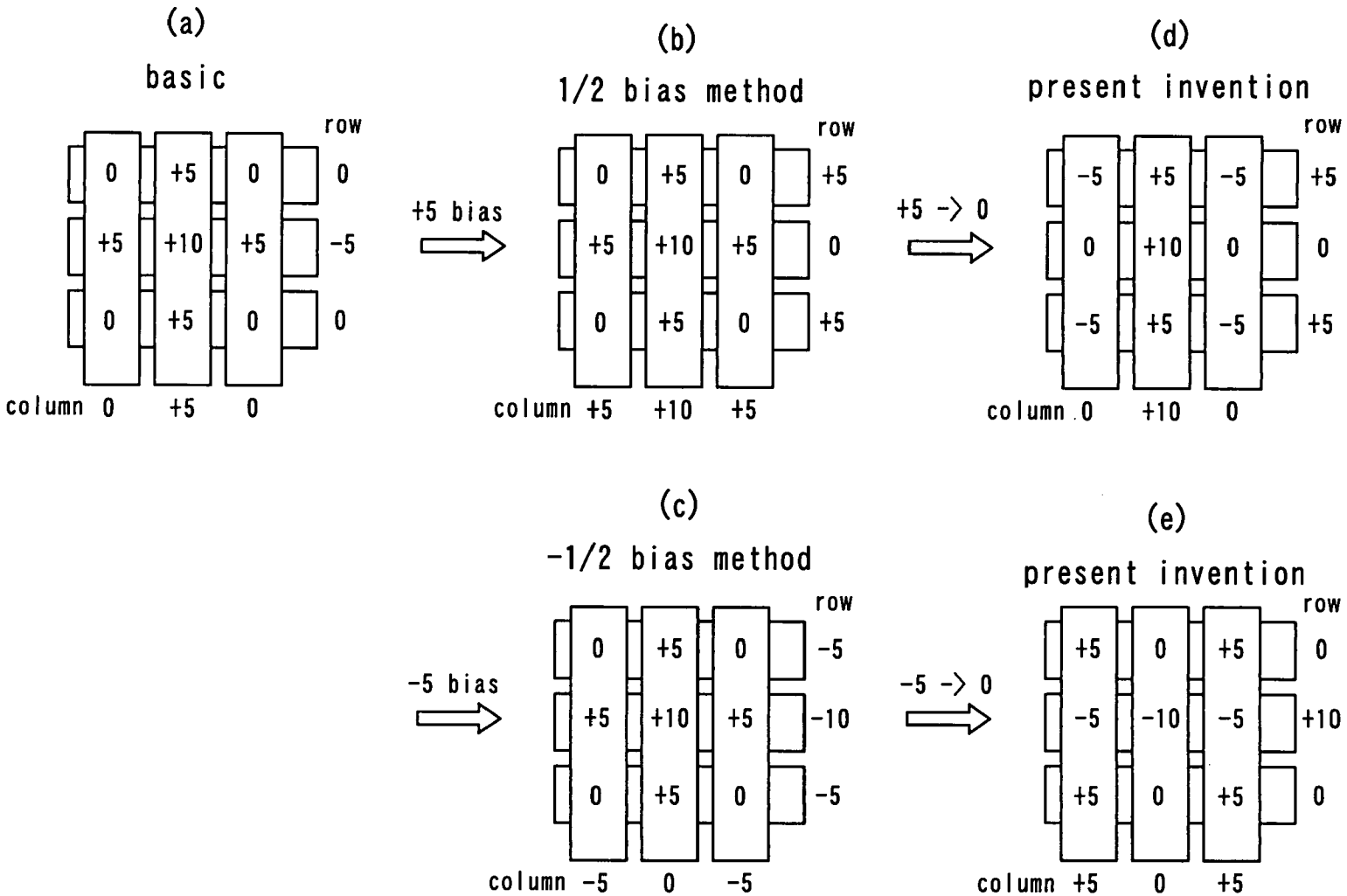
FIGS. 4*a* to 4*e* are schematic views respectively showing one example of the method for driving an information display device according to the invention in comparison with the prior art.

FIG. 4*a* is a view showing a principle of passive matrix drive and illustrating the case that display switching voltage of the information display panel is 10V. In the case of driving the central pixel in 3×3 matrix, −5V is applied to the second row and 5V to the second column, so that the subtraction of these voltages of 10V (=5V−(−5V)) is applied to the central pixel. Therefore, the pixel is driven to display the predetermined image (for example black display). In this case, negative voltage should be applied to either of row or column.

FIGS. 4*b* and 4*c* are views respectively showing the prior techniques of "½ bias method" and "−½ bias method" to achieve passive matrix drive. As shown in these figures, in the case of biasing applied voltage to the row and column as ½ of the drive voltage, negative and positive voltages among applied voltages do not occur, so that the applied voltages, which are completely the same as that in FIG. 4*a* become homopolarity. However, in this case two kinds of voltage, not 0V, to the row side in FIG. 4*b* and to the column side in FIG. 4*c* are necessary simultaneously so that "a drive integrated circuit (driver IC) with normal C-MOS output stage structure capable of outputting only one kind of voltage except for 0V" cannot be used and "an expensive driver IC capable of outputting two or more kinds of voltages" should be used.

In the present invention as shown in FIGS. 4*d* and 4*e*, two kinds of voltages, lower one of which is 0V (ground level), are applied respectively to each rows and columns so that "an inexpensive driver IC with normal C-MOS output stage structure can be used, in which only two kinds of voltages, one is 0V and the other is driving voltage which is 5V in writing (for example in switching to black ) and 10V in deleting (for example in switching to white), can be output". In this case, the lower of two kinds of voltages is 0V, therefore, the absolute value of crosstalk is not increased.

When the driving method shown in FIGS. 4*d* and 4*e* is adopted, two patterns of disturbed symmetrical property of applied voltage occur and a portion where crosstalk voltage is 0V (a portion free from the influence of cross talk) occurs along the row direction in FIG. 4*d* and the column direction in FIG. 4*e*. In the case of making a comparison between FIG. 4*d* and FIG. 4*e*, in FIG. 4*e*negative crosstalk voltage (−5V) occurs only in the selected row, therefore, crosstalk occurs for just a moment during one image forming. The crosstalk voltage is applied repeatedly during scanning rows to form one image. However, when the constitution shown in FIG. 4*e* is adopted, crosstalk toward the minus direction in the figure (for example, crosstalk to turn a pixel that should be black into white) occurs only once so as to minimize the influence of crosstalk.

In one example of the method for driving an information display device according to the present invention mentioned above, "an inexpensive driver IC with general C-MOS output stage structure, in which only two kinds of voltages, one is 0V and the other is driving voltage which is 5V in writing (for example in switching to black ) and 10V in deleting (for example in switching to white), can be output" is used to achieve cost reduction of the drive circuit. In another example of the method for driving an information display device according to the present invention, as shown in following embodiments in detail, a drive circuit in which ground level of an analog circuit can be set independent of ground level of a digital circuit, is used so that "an inexpensive driver IC with general C-MOS output stage structure with low withstand voltage" is used instead of "an expensive driver IC capable of outputting both driving voltage and intermediate voltage" to achieve cost reduction of the drive circuit.

According to the method for driving an information display device of the present invention, when the information display device is driven, it is driven by means of a driver IC having an output stage equivalent circuit capable of outputting only two values of a predetermined drive voltage value and ground level, or by means of a drive circuit in which ground level of an analog circuit can be set independent of ground level of a digital circuit, so that "an inexpensive driver IC with C-MOS output stage structure, in which only two kinds of voltages, one is 0V and the other is driving voltage can be output" or "an inexpensive driver IC with general C-MOS output stage structure with low withstand voltage" can be used to configure the drive circuit and then cost reduction of the information display device becomes possible.

Explanation of the Forth and Fifth Inventions)

The characteristics of the method for driving an information display device according to the present invention is that in the information display device of the above-mentioned configuration, while information is not refreshed (scanned), electrodes of the information display device are connected to predetermined potential in the driving voltage range with low impedance. Although any means are available in order to connect the electrodes to the predetermined potential in the driving voltage range with low impedance, a circuit explained below is preferably used.

Figure 5:
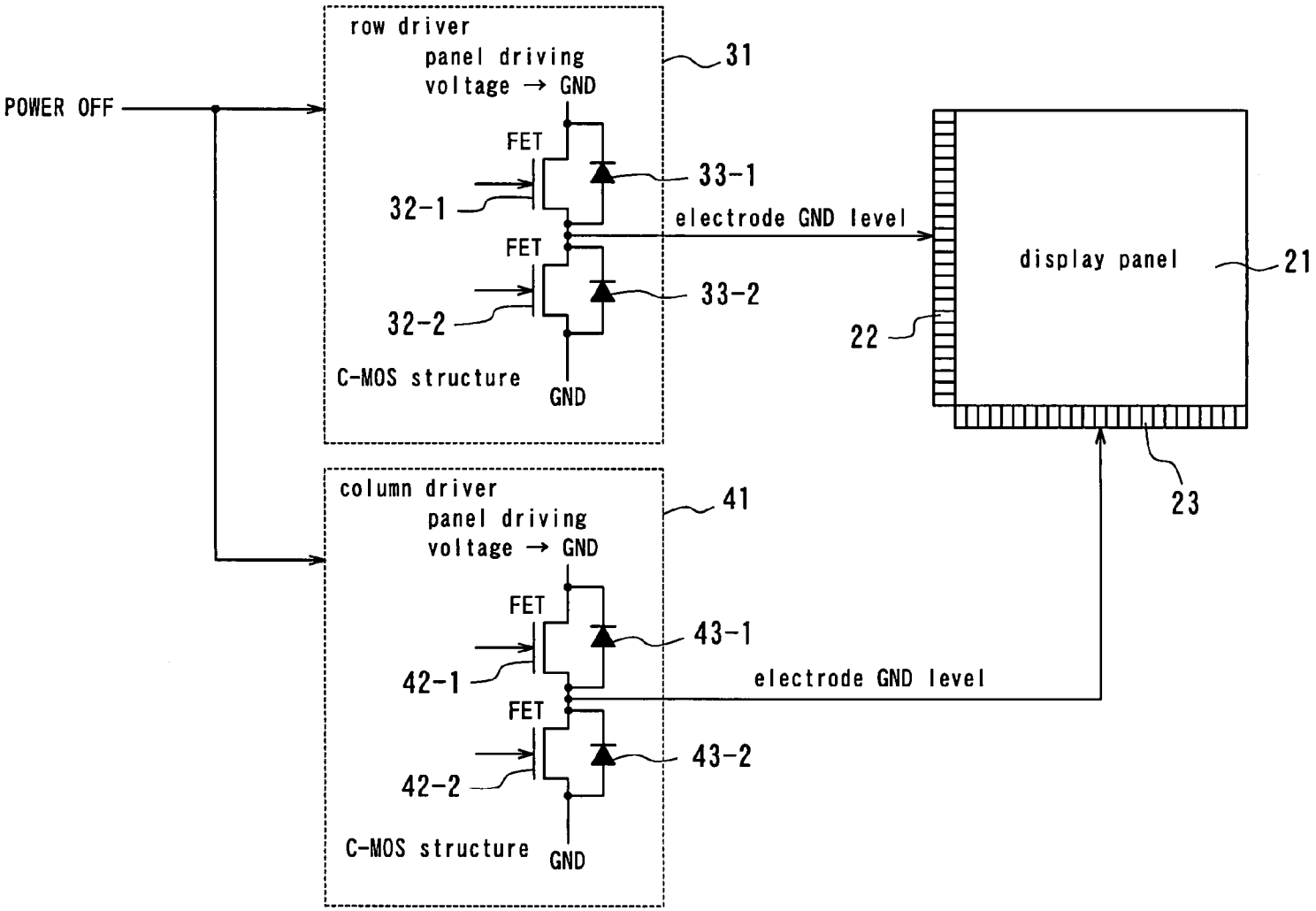
FIG. 5 is a block diagram showing one example of the method for driving an information display device according to the invention.

FIG. 5 is a block diagram showing one example of the method for driving an information display device according to the invention. In the example shown in FIG. 5, in a display panel 21 panel driving voltage is applied to a terminal 22 of the row direction by a row driver 31 while panel driving voltage is applied to a terminal 23 of the column direction by a column driver 41. The output stage of the row driver 31 has CMOS structure with two FETs 32-1 and 32-2, in which two body diodes 33-1 and 33-2 are provided with source-to-drain in C-MOS structure. Similarly, the output stage of the column driver 41 has CMOS structure with two FETs 42-1 and 42-2, in which two body diodes 43-1 and 43-2 are provided with source-to-drain in C-MOS structure.

In the example shown in FIG. 5, the panel driving circuit is configured so that panel driving power source, from which power is supplied to the row driver 31 and the column driver 41, is dropped to GND level in power-off state. Therefore, even in power-off state, FETs 42-1 and 42-2 of the output stage, body diodes 33-1 and 33-2 between source-to-drain of FETs 32-1 and 32-2, or body diodes 43-1 and 43-2 are used to connect the driver output terminals (i.e. terminals 22 and 23 of the display panel 21) to GND level with low impedance.

In this case, low impedance is thought to be valid from the test result when it is not more than 1/10 of impedance of the panel 21. In the case of the information display device using display media according to the present invention, no problems happen during the aerial discharge test up to +/−8 kV when terminals are connected to GND level with no more than 1M ohm impedance.

Hereinafter, respective members of the information display panel according to the invention will be explained in detail.

As for the substrate, at least one of the substrates is the transparent substrate 2 through which a color of the particles can be observed from outside of the information display panel, and it is preferred to use a material having a high transmission factor of visible light and an excellent heat resistance. The back substrate 1 may be transparent or opaque. Examples of the substrate material include polymer sheets such as polyethylene terephthalate, polyether sulfone, polyethylene, polycarbonate, polyimide or acryl and metal sheets having flexibility and inorganic sheets such as glass, quartz or the like having no flexibility. The thickness of the substrate is preferably 2 to 5000 μm, more preferably 5 to 2000 μm. When the thickness is too thin, it becomes difficult to maintain strength and distance uniformity between the substrates, and when the thickness is thicker than 5000 μm, it is inconvenient for the thin information display panel.

When electrodes are provided with the information display panel, as materials for forming the electrodes , metals such as aluminum, silver, nickel, copper, gold and so on, conductive metal oxides such as ITO, indium oxide, conductive tin oxide and conductive zinc oxide and so on, and conductive polymer such as polyaniline, polypyrrole, polythiophene and so on are listed and appropriately used. As the method for forming the electrode, the method in which a thin film is formed from the above-listed materials by sputtering method, vacuum vapor deposition method, CVD (chemical vapor deposition) method, and coating method, or the method in which the mixed solution of an conductive agent with a solvent or a synthetic resin binder is applied, are used. The electrode disposed on the substrate at the observation side (display side) should be transparent but the electrode disposed on the back substrate may not be transparent. In both cased, above-mentioned conductive material capable of pattern forming can be preferably used. Additionally, the thickness of the electrode is preferable to be 3 to 1000 nm, more preferable to be 5 to 400 nm so that the electro-conductivity and optical transparency can be maintained. The material and the thickness of the electrode arranged on the back substrate are the same as those of the electrode arranged at the display side, but transparency is not necessary. In this case, the applied outer voltage may be superimposed with a direct current or an alternate current.

As for the partition wall 4 provided if necessary, a shape of the partition wall is suitably designed in accordance with a kind of the display media used for the display and is not restricted. However, it is preferred to set a width of the partition wall to 2-100 μm more preferably 3-50 μm and to set a height of the partition wall to 10-500 μm more preferably 10-200 μm. Moreover, there are a double rib method and single rib method as a method of forming the partition wall. In the double rib method ribs are formed on the opposed substrates respectively and then connected with each other. In the single rib method a rib is formed on one of the opposed substrates only. Both methods mentioned above may be preferably applied to the present invention.

Figure 6:
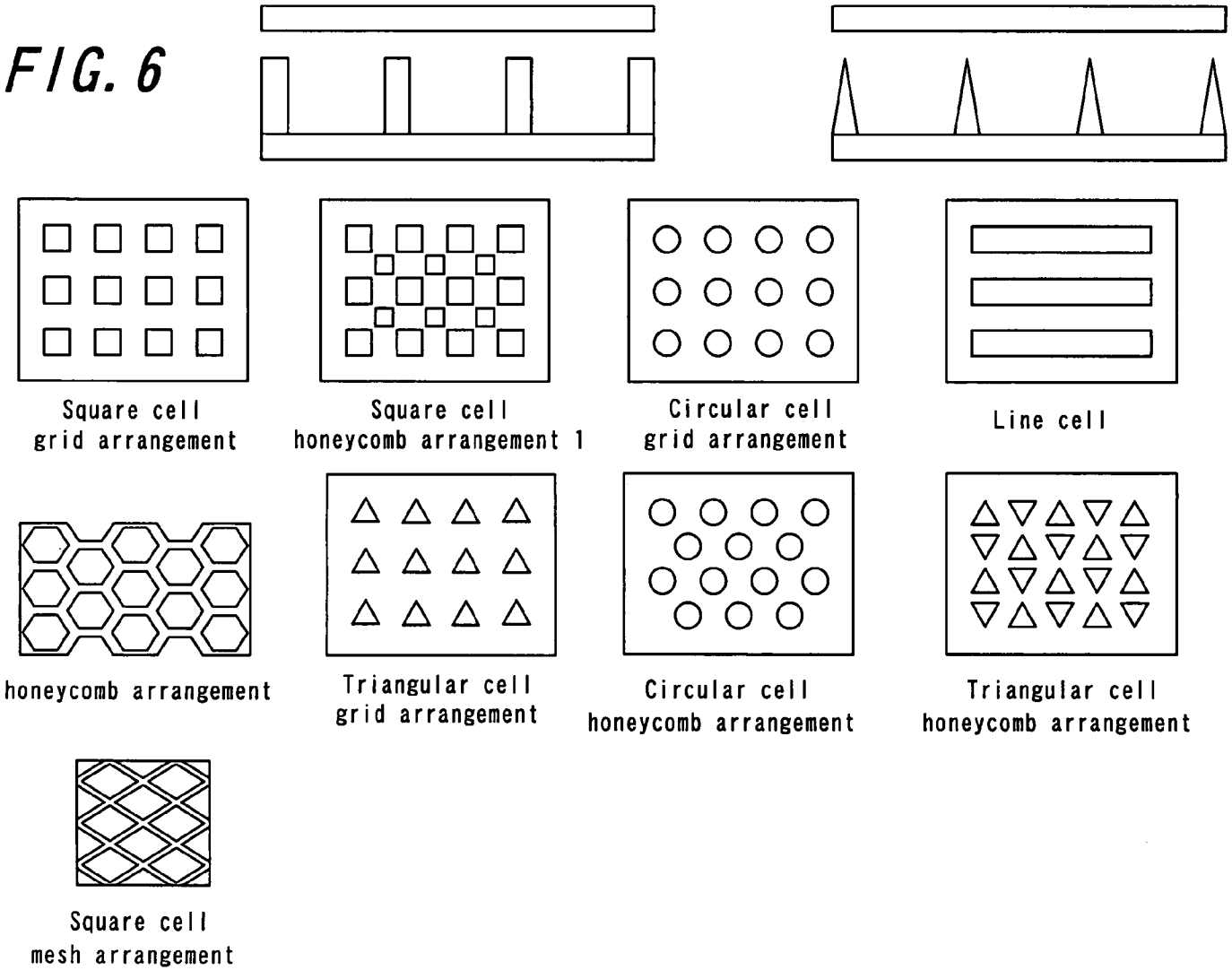
FIG. 6 is a schematic view showing one example of a shape of the partition walls in the information display panel according to the invention.

The cell formed by the partition walls each made of rib has a square shape, a triangular shape, a line shape, a circular shape and a hexagon shape, and has an arrangement such as a grid, a honeycomb and a mesh, as shown in FIG. 6 viewed from a plane surface of the substrate. It is preferred that the portion corresponding to a cross section of the partition wall observed from the display side (an area of the frame portion of the display cell) should be made as small as possible, so that sharpness of the image display can be improved. As the formation method of the partition wall there are a die transferring method, a screen-printing method, a sandblast method, a photolithography method and an additive method. Among them, it is preferred to use a photolithography method using a resist film and a die transferring method.

Next, the particles used for the display media in the information display panel according to the invention will be explained. A particle constituting the particles, which is mainly formed by resin can contain, if necessary, charge control agent, coloring agent, inorganic additive and the like same as a conventional particle. Hereinafter, resin, contain charge control agent, coloring agent and other additive will be listed.

Typical examples of the resin include urethane resin, urea resin, acrylic resin, polyester resin, acryl urethane resin, acryl urethane silicone resin, acryl urethane fluorocarbon polymers, acryl fluorocarbon polymers, silicone resin, acryl silicone resin, epoxy resin, polystyrene resin, styrene acrylic resin, polyolefin resin, butyral resin, vinylidene chloride resin, melamine resin, phenolic resin, fluorocarbon polymers, polycarbonate resin, polysulfon resin, polyether resin, and polyamide resin. Two kinds or more of these may be mixed and used. For the purpose of controlling the adherence to the substrate, acryl urethane resin, acryl silicone resin, acryl fluorocarbon polymers, acryl urethane silicone resin, acryl urethane fluorocarbon polymers, fluorocarbon polymers, silicone resin are particularly preferable.

Though charge control agents are not particularly specified to the following examples, examples of the negative charge control agent include salicylic acid metal complex, metal containing azo dye, oil-soluble dye of metal-containing (containing a metal ion or a metal atom), the fourth grade ammonium salt-based compound, calixarene compound, boron-containing compound (benzyl acid boron complex), and nitroimidazole derivative. Examples of the positive charge control agent include nigrosine dye, triphenylmethane compound, the fourth grade ammonium salt-based compound, polyamine resin, imidazole derivatives. Additionally, metal oxides such as ultra-fine particles of silica, ultra-fine particles of titanium oxide, ultra-fine particles of alumina, and so on; nitrogen-containing circular compound such as pyridine, and so on, and these derivates or salts; and resins containing various organic pigments, fluorine, chlorine, nitrogen and the like can be employed as the charge control agent.

As for a coloring agent, various kinds of organic or inorganic pigments or dye with various colors as described below are usable.

Examples of black pigments include carbon black, copper oxide, manganese dioxide, aniline black, activate carbon and the like.

Examples of blue pigments include C.I. pigment blue 15:3, C.I. pigment blue 15, Berlin blue, cobalt blue, alkali blue lake, Victoria blue lake, phthalocyanine blue, metal-free phthalocyanine blue, partially chlorinated phthalocyanine blue, first sky blue, Indanthrene blue BC and the like.

Examples of red pigments include red oxide, cadmium red, diachylon, mercury sulfide, cadmium, permanent red 4R, lithol red, pyrazolone red, watching red, calcium salt, lake red D, brilliant carmine 6B, eosin lake, rhodamine lake B, alizarin lake, brilliant carmine 3B, C.I. pigment red 2 and the like.

Examples of yellow pigments include chrome yellow, zinc chromate, cadmium yellow, yellow iron oxide, mineral first yellow, nickel titanium yellow, navel orange yellow, naphthol yellow S, hansa yellow G, hansa yellow 10G, benzidine yellow G, benzidine yellow GR, quinoline yellow lake, permanent yellow NCG, tartrazinelake, C.I. pigment yellow 12 and the like.

Examples of green pigments include chrome green, chromium oxide, pigment green B, C.I. pigment green 7,Malachite green lake, final yellow green G and the like.

Examples of orange pigments include red chrome yellow, molybdenum orange, permanent orange GTR, pyrazolone orange, Balkan orange, Indanthrene brilliant orange RK, benzidine orange G, Indanthrene brilliant orange GK, C.I. pigment orange 31 and the like.

Examples of purple pigments include manganese purple, first violet B, methyl violet lake and the like.

Examples of white pigments include zinc oxide, titanium oxide, antimony white, zinc sulphide and the like.

Examples of extenders include baryta powder, barium carbonate, clay, silica, white carbon, talc, alumina white and the like. Furthermore, there are Nigrosine, Methylene Blue, rose bengal, quinoline yellow, and ultramarine blue as various dyes such as basic dye, acidic dye, dispersion dye, direct dye, etc.

Examples of inorganic additives include titanium oxide, zinc oxide, zinc sulphide, antimony oxide, calcium carbonate, pearl white, talc, silica, calcium silicate, alumina white, cadmium yellow, cadmium red, cadmium orange, titanium yellow, Berlin blue, Armenian blue, cobalt blue, cobalt green, cobalt violet, ion oxide, carbon black, manganese ferrite black, cobalt ferrite black, copper powder, aluminum powder and the like.

Inorganic additives among these coloring agents may be used alone or in combination with two or more kinds thereof. Particularly, carbon black is preferable as the black coloring agent, and titanium oxide is preferable as the white coloring agent.

Moreover, it is preferable to use particles according to the present invention, whose average particle diameter d(0.5) ranges between 0.1 to 20 μm and which are even. If the average particle. diameter d(0.5) exceeds this range, the image sharpness is sometimes deteriorated, and, if the average particle diameter is smaller than this range, an agglutination force between the particles becomes too large to prevent the movement of the particles.

Further, in the present invention as for the particle diameter distribution, the particle diameter distribution Span, which is defined by the following formula, is less than 5 preferably less than 3:

$$\text{Span}=(d(0.9)-d(0.1))/d(0.5)$$

(here, d(0.5) means a value of the particle diameter expressed by μm wherein an amount of the particles having the particle size larger than or smaller than this value is 50%, d(0.1) means a value of the particle diameter expressed by μm wherein an amount of the particles having the particle size smaller than this value is 10%, and d(0.9) means a value of the particle size expressed by μm wherein an amount of the particles having the particle size smaller than this value is 90%).

When the Span is set to no more than 5, each particle has similar particle diameter to perform an even particle movement.

Furthermore, as for a correlation between each particles, it is crucial to set a ratio of d(0.5) of the particles having smallest diameter with respect to d(0.5) of the particles having largest diameter to not more than 50 preferably not more than 10. Even if the particle diameter distribution Span is made smaller, the particles having different charge properties with each other are moved in the opposite direction. Therefore, it is preferred that the particle diameters are formed closely with each other and equivalent amounts of the particles are easily moved in the opposite direction. To this end, the above range is obtained.

Here, the particle diameter distribution and the particle diameter mentioned above can be measured by means of a laser diffraction/scattering method. When a laser light is incident upon the particles to be measured, a light intensity distribution pattern due to a diffraction/scattering light occurs spatially. This light intensity distribution pattern corresponds to the particle diameter, and thus it is possible to measure the particle diameter and the particle diameter distribution.

In the present invention, the particle diameter and the particle diameter distribution are obtained by a volume standard distribution. Specifically, the particle diameter and the particle diameter distribution can be measured by means of a measuring apparatus Mastersizer 2000 (Malvern Instruments Ltd.) wherein the particles setting in a nitrogen gas flow are calculated by an installed analysis software (which is based on a volume standard distribution due to Mie's theory).

A charge amount of the display media properly depends upon the measuring condition. However, it has been found that the charge amount of the display media in the information display panel substantially depends upon an initial charge amount, a contact with respect to the partition walls, a contact with respect to the substrates, a charge decay due to an elapsed time, and specifically a saturation value of the particles for the display media during a charge behavior is a main factor.

After various investigations by the inventors, it is found that an adequate range of the charged values of each particles can be estimated by performing a blow-off method utilizing the same carrier particles so as to measure the charge amount of the particles.

Then, the liquid powders used as the display in the information display device according to the present invention will be explained. The applicant has the right of the name of the liquid powders utilized in the information display device of the present invention as "electric liquid powders (trade mark)".

In the present invention, a term "liquid powders" means an intermediate material having both of liquid properties and particle properties and exhibiting a self-fluidity without utilizing gas force and liquid force. For example, a liquid crystal is defined as an intermediate phase between a liquid and a solid, and has a fluidity showing a liquid characteristic and an anisotropy (optical property) showing a solid characteristic (Heibonsha Ltd.: encyclopedia). On the other hand, a definition of the particle is a material having a finite mass even if it is vanishingly small and receives an attraction of gravity (Maruzen Co., Ltd.: physics subject-book). Here, even in the particles, there are special states such as gas-solid fluidized body and liquid-solid fluidized body. If a gas is flown from a bottom plate to the particles, an upper force is acted with respect to the particles in response to a gas speed. In this case, the gas-solid fluidized body means a state that is easily fluidized when the upper force is balanced with the gravity. In the same manner, the liquid-solid fluidized body means a state that is fluidized by a liquid. (Heibonsha Ltd.: encyclopedia) In the present invention, it is found that the intermediate material having both of fluid properties and solid properties and exhibiting a self-fluidity without utilizing gas force and liquid force can be produced specifically, and this is defined as the liquid powders.

That is, as is the same as the definition of the liquid crystal (intermediate phase between a liquid and a solid), the liquid powder according to the invention is a material showing the intermediate state having both of liquid properties and particle properties, which is extremely difficult to receive an influence of the gravity showing the particle properties mentioned above and indicates a high fluidity. Such a material can be obtained in an aerosol state i.e. in a dispersion system wherein a solid-like or a liquid-like material is floating in a relatively stable manner as a dispersant in a gas, and thus, in the information display panel according to the invention, a solid material is used as a dispersant.

In the information display panel which is a target of the present invention, the liquid powders composed of a solid material stably floating as a dispersant in a gas and exhibiting a high fluidity in an aerosol state are sealed between two opposed substrates, at least one substrate being transparent. Such liquid powders can be made to move easily and stably by means of Coulomb's force and so on generated by applying a low voltage.

As mentioned above, the liquid powders according to the present invention means an intermediate material having both of liquid properties and particle properties and exhibiting a self-fluidity without utilizing gas force and liquid force. Such liquid powders become particularly an aerosol state. In the information display panel according to the invention, the liquid powders are used in a state such that a solid material is relatively stably floating as a dispersant in a gas.

As the aerosol state, it is preferred that an apparent volume in a maximum floating state is two times or more, more preferably 2.5 times or more, and most preferably three times or more than that in none floating state. In this case, an upper limit is not defined, but it is preferred that an apparent volume is 12 times or less than that in none floating state.

If the apparent volume in the maximum floating state is less than two times than that in none floating state, a display controlling may become difficult. On the other hand, if the apparent volume in the maximum floating state is more than 12 times, a handling inconvenience during a liquid powders filling operation into the device such as a particle over-scattering may occur. The apparent volume in the maximum floating state is measured as follows. That is, it is measured by filling the liquid powders in a transparent closed vessel through which the liquid powders are seen; vibrating or dropping the vessel itself to obtain a maximum floating state; and measuring an apparent volume at that time from outside of the vessel. Specifically, the liquid powders having a volume ⅕ of the vessel in none floating state are filled in a vessel having a average particle diameter (inner diameter) of 6 cm and a height of 10 cm with a polypropylene cap (product name I-boy produced by As-one Co., Ltd.), the vessel is set in the vibrator, and a vibration wherein a distance of 6 cm is repeated at a speed of 3 reciprocating/sec. is performed for 3 hours. Then, the apparent volume in the maximum floating state is obtained from an apparent volume just after a vibration stop.

Moreover, in the information display panel according to the invention, it is preferred that a time change of the apparent volume of the liquid powders satisfies the following formula:

$$V_{10}/V_5>0.8;$$

here, $V_5$ indicates the apparent volume ($cm^3$) of the liquid powders after 5 minutes from the maximum floating state; and $V_{10}$ indicates the apparent volume ($cm^3$) of the liquid powders after 10 minutes from the maximum floating state. In this case, in the information display device according to the invention, it is preferred that the time change $V_{10}/V_5$ of the apparent volume of the liquid powders is larger than 0.85, more preferably larger than 0.9. If the time change $V_{10}/V_5$ is not larger than 0.8, the liquid powders are substantially equal to normal particles, and thus it is not possible to maintain a fast response and effect of durability according to the invention.

Moreover, the average particle diameter d(0.5) (d(0.5)) of the particle materials constituting the liquid powders is preferably 0.1-20 μm, more preferably 0.5-15 μm, most preferably 0.9-8 μm. If the average particle diameter d(0.5) is less than 0.1 μm, a display controlling may become difficult. On the other hand, if the average particle diameter d(0.5) is larger than 20 μm, sharpness of the image display may be degraded. The average particle diameter d(0.5) (d(0.5)) of the particle materials constituting the liquid powders is equal to d(0.5) in the following particle diameter distribution Span.

The particle diameter distribution Span of the particle material constituting the liquid powders, which is defined by the following formula, is preferably less than 5, more preferably less than 3:

$$\text{Particle diameter distribution Span}=(d(0.9)-d(0.1))/d(0.5);$$

here, d(0.5) means a value of the particle diameter expressed by Am wherein an amount of the particle material constituting the liquid powders having the particle diameter larger than this value is 50% and an amount of the particle material constituting the liquid powders having the particle diameter expressed by μm wherein an amount of the particle material constituting the liquid powders having a particle diameter smaller than this value is 10%, and d(0.9) means a value of the particle diameter expressed by μm wherein an amount of the particle material constituting the liquid powders having the particle diameter smaller than this value is 90%.

When the particle diameter distribution Span of the particle materials constituting the liquid powders is set to no more than 5, each liquid particle has similar particle diameter to perform an even liquid particle movement.

Here, the particle diameter distribution and the particle diameter mentioned above can be measured by means of a laser diffraction/scattering method. When a laser light is incident upon the liquid particles to be measured, a light intensity distribution pattern due to a diffraction/scattering light occurs spatially. This light intensity distribution pattern corresponds to the particle diameter, and thus it is possible to measure the particle diameter and the particle diameter distribution. The particle diameter and the particle diameter distribution are obtained by a volume standard distribution. Specifically, the particle diameter and the particle diameter distribution can be measured by means of a measuring apparatus Mastersizer 2000 (Malvern Instruments Ltd.) wherein the particles setting in a nitrogen gas flow are calculated by an installed analysis software (which is based on a volume standard distribution due to Mie's theory).

The liquid powders may be formed by mixing/grinding necessary resin, charge control agent, coloring agent, other additives, by polymerizing from monomer or by coating a known particle with resin, charge control agent, coloring agent, and other additives. Hereinafter, typical examples of resin, charge control agent, coloring agent, other additives constituting the liquid powders will be explained.

Examples of the resin include urethane resin, acrylic resin, polyester resin, acrylic urethane resin, silicone resin, nylon resin, epoxy resin, styrene resin, butyral resin, vinylidene chloride resin, melamine resin, phenolic resin, fluorocarbon polymers and the like. It is also possible to combine two or more resins. For the purpose of controlling the adherence to the substrate, acryl urethane resin, acryl urethane silicone resin, acryl urethane fluorocarbon polymers, urethane resin and fluorocarbon polymers are preferred.

Examples of the charge control agent include positive charge control agents such as the fourth grade ammonium salt compound, nigrosine dye, triphenylmethane compound, imidazole derivatives, and so on, and negative charge control agents such as metal containing azo dye, salicylic acid metal complex, nitroimidazole derivative and so on.

As for a coloring agent, various kinds of organic or inorganic pigments or dye with various colors as described below are usable.

Examples of black pigments include carbon black, copper oxide, manganese dioxide, aniline black, activate carbon and the like.

Examples of blue pigments include C.I. pigment blue 15:3, C.I. pigment blue 15, Berlin blue, cobalt blue, alkali blue lake, Victoria blue lake, phthalocyanine blue, metal-free phthalocyanine blue, partially chlorinated phthalocyanine blue, first sky blue, Indanthrene blue BC and the like.

Examples of red pigments include red oxide, cadmium red, diachylon, mercury sulfide, cadmium, permanent red 4R, lithol red, pyrazolone red, watching red, calcium salt, lake red D, brilliant carmine 6B, eosin lake, rhodamine lake B, alizarin lake, brilliant carmine 3B, C.I. pigment red 2 and the like.

Examples of yellow pigments include chrome yellow, zinc chromate, cadmium yellow, yellow iron oxide, mineral first yellow, nickel titanium yellow, navel orange yellow, naphthol yellow S, hansa yellow G, hansa yellow 10G, benzidine yellow G, benzidine yellow GR, quinoline yellow lake, permanent yellow NCG, tartrazinelake, C.I. pigment yellow 12 and the like.

Examples of green pigments include chrome green, chromium oxide, pigment green B, C.I. pigment green 7,Malachite green lake, final yellow green G and the like.

Examples of orange pigments include red chrome yellow, molybdenum orange, permanent orange GTR, pyrazolone orange, Balkan orange, Indanthrene brilliant orange RK, benzidine orange G, Indanthrene brilliant orange GK, C.I. pigment orange 31 and the like.

Examples of purple pigments include manganese purple, first violet B, methyl violet lake and the like.

Examples of white pigments include zinc oxide, titanium oxide, antimony white, zinc sulphide and the like.

Examples of extenders include baryta powder, barium carbonate, clay, silica, white carbon, talc, alumina white and the like. Furthermore, there are Nigrosine, Methylene Blue, rose bengal, quinoline yellow, and ultramarine blue as various dyes such as basic dye, acidic dye, dispersion dye, direct dye, etc.

Examples of inorganic additives include titanium oxide, zinc oxide, zinc sulphide, antimony oxide, calcium carbonate, pearl white, talc, silica, calcium silicate, alumina white, cadmium yellow, cadmium red, cadmium orange, titanium yellow, Berlin blue, Armenian blue, cobalt blue, cobalt green, cobalt violet, ion oxide, carbon black, manganese ferrite black, cobalt ferrite black, copper powder, aluminum powder and the like.

Inorganic additives among these coloring agents may be used alone or in combination with two or more kinds thereof. Particularly, carbon black is preferable as the black coloring agent, and titanium oxide is preferable as the white coloring agent.

Further, in the present invention, it is important to control a gas surrounding the display media (particles or liquid powders) in a gap between the substrates, and a suitable gas control contributes an improvement of display stability. Specifically, it is important to set the relative humidity of the gas in the gap not more than 60% RH at 25° C., preferably not more than 50% RH, more preferably not more than 35% RH.

The above gap means a gas portion surrounding the display media obtained by substituting occupied portions of the electrodes 5, 6 (in the case of arranging the electrodes inside the substrates), the display media (particles or liquid powders) 3 and the partition walls 4 (in the case of arranging the partition wall) and a seal portion of the information display panel from the space between the opposed substrates 1 and 2 shown in FIGS. 1*a* and 1*b*.

A kind of the gap gas is not limited as long as it has the humidity mentioned above, but it is preferred to use dry air, dry nitrogen gas, dry argon gas, dry helium gas, dry carbon dioxide gas, dry methane gas and so on. It is necessary to seal this gas in the information display panel so as to maintain the humidity mentioned above. For example, it is important to perform the operations of filling the particles or liquid powders and assembling the information display panel under an atmosphere having a predetermined humidity and to apply a seal member and a seal method for preventing a humidity inclusion from outside.

In the information display panel according to the invention, an gap between the substrates may be adjusted so that the display media can be moved to maintain the contrast. The gap is adjusted normally to 10-500 μm, preferably 10-200 μm.

The volume occupied rate of the display media in a space between the opposed substrates is preferably 5-70%, more preferably 5-60%. If the volume occupied rate of the display media exceeds 70%, the display media may become difficult to move, and if it is less than 5%, a sufficient contrast cannot be obtained and a sharp image display is not performed.

Embodiments

Hereinafter, examples according to the first to third inventions of the present invention are shown so as to be explained further specifically. However, the present invention is not limited to the following examples.

Embodiment 1

Drive circuits of the information display devices whose driving principle is shown in FIGS. 4*d* and 4*e* were produced. In this case, "inexpensive driver ICs with normal C-MOS output stage structure, capable of outputting two values of 0V and driving voltage (5V)" were used instead of "expensive driver ICs having a function of outputting two kinds of voltage".

According to the information display devices of the embodiment 1, by contriving the applied voltage waveform to either of rows or columns, the most inexpensive driver IC with C-MOS output stage capable of outputting only two values of 0V and the driving voltage was used to enable passive matrix drive so that cost reduction of the drive circuit could be attained, which leads to cost reduction of the information display device.

Embodiment 2

Figure 7:
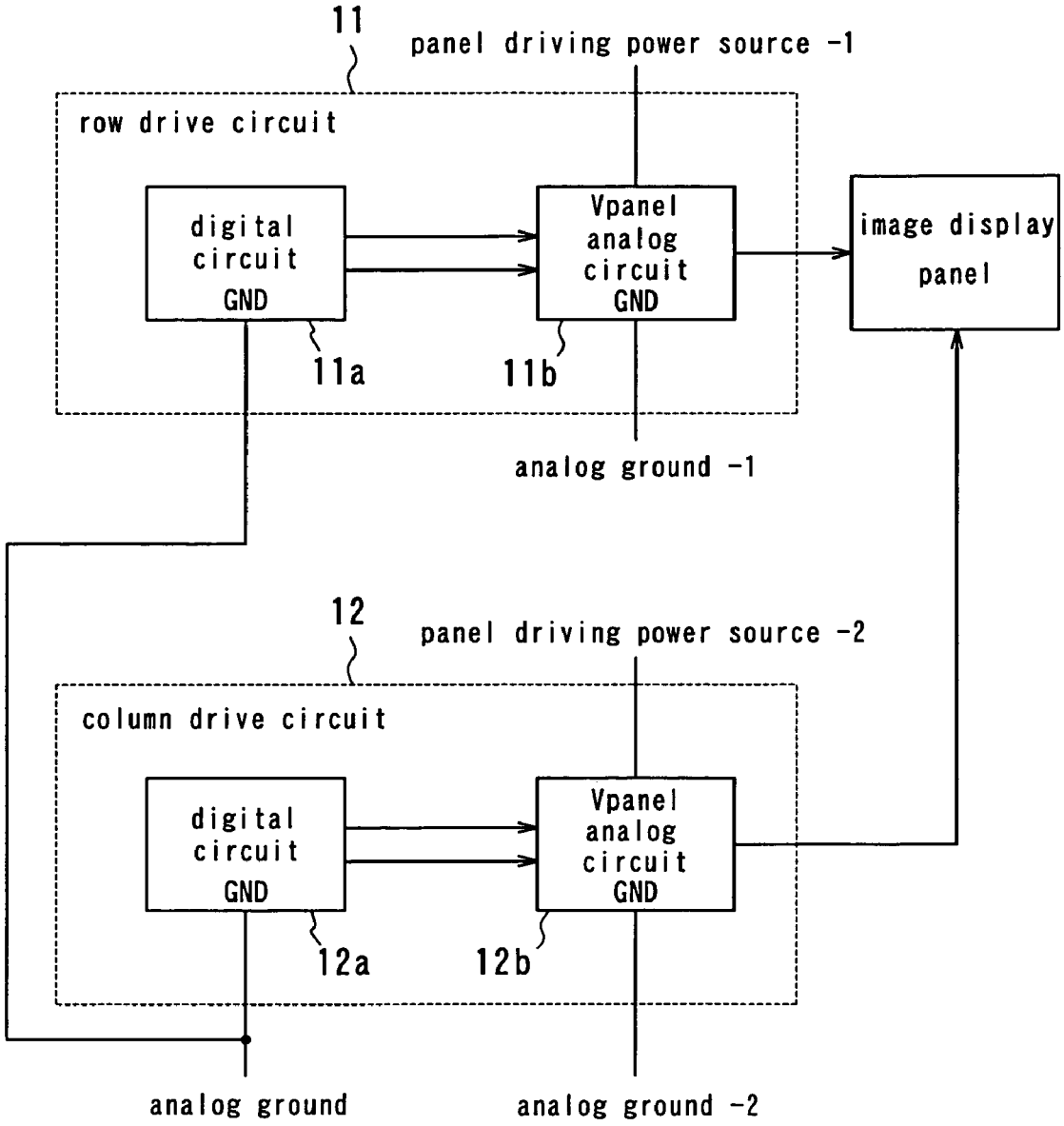
FIG. 7 is a schematic view showing drive circuit of the information display device of the second embodiment according to the invention.

A drive circuit of the information display device shown in FIG. 7 was produced. The drive circuit of embodiment 2 consisted of a row drive circuit 11 and a column drive circuit 12, the row drive circuit 11 consisted of a digital circuit 11*a* and an analog circuit 11*b*, and the column drive circuit 12 consisted of a digital circuit 12*a* and an analog circuit 12*b*. It was arranged that communication was transferred respectively from the digital circuit 11*a* to the analog circuit 11*b* and from the digital circuit 12*a* to the analog circuit 12*b* by differential signals, therefore, each ground levels could be set separately. The digital circuits 11*a* and 12*a* had GND output terminals of digital ground for common connection. The analog circuit 11*b* had a Vpanel output terminal of a panel driving power source −1 and a GND output terminal of an analog ground −1, while the analog circuit 12*b* had a Vpanel output terminal of a panel driving power source −2 and a GND output terminal of an analog ground −2. The digital ground, the panel driving power sources −1 and −2, the analog grounds −1 and −2 shown in the figure could be independently set.

Figure 8:
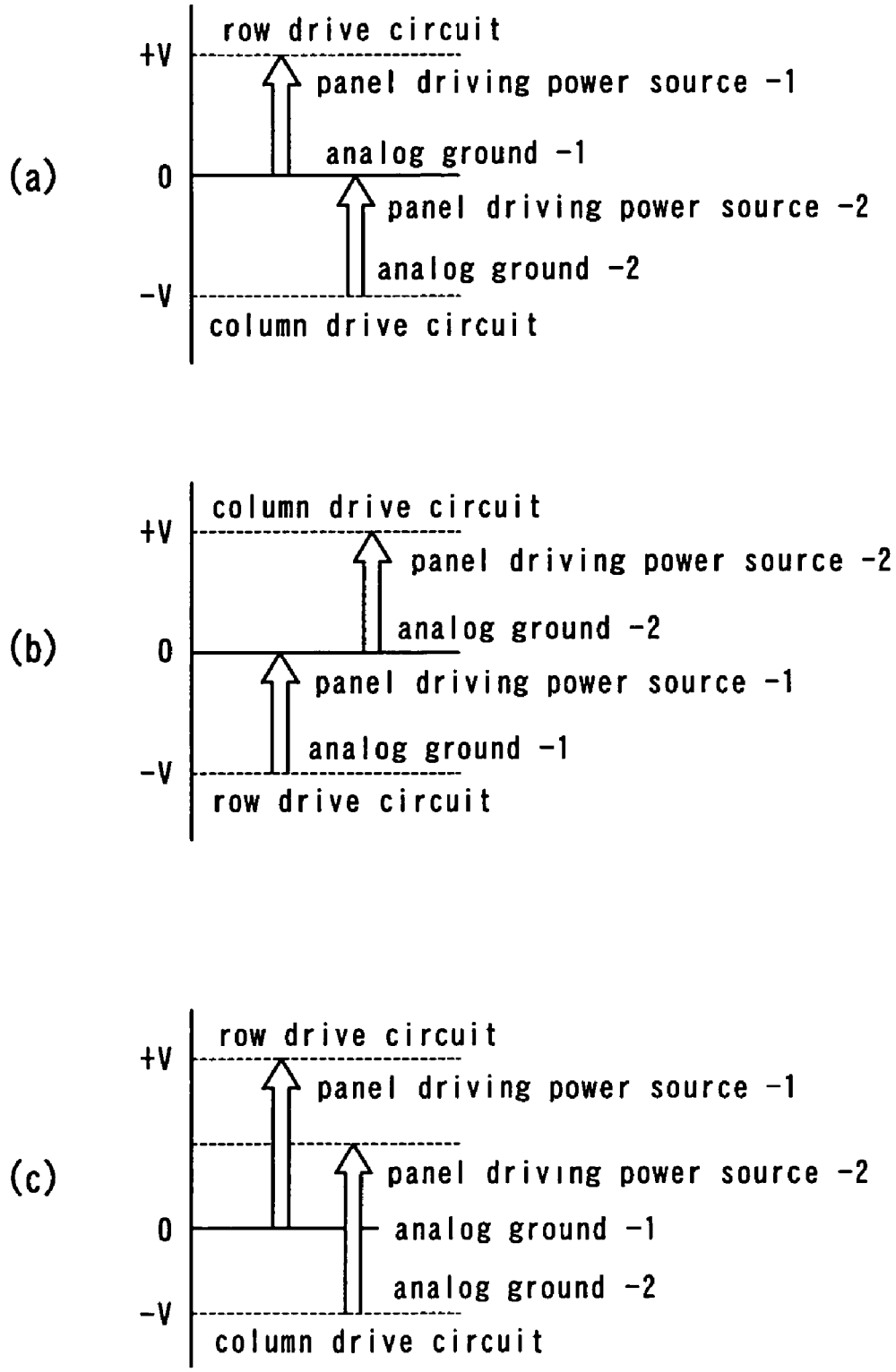
FIGS. 8*a* to 8*c* are schematic views respectively showing driving voltages used for drive circuit of the information display device of the second embodiment.

In the drive circuit of embodiment 2 mentioned above, as shown in FIG. 8*a*, the row drive circuit 11 applied the voltage of +V between the panel driving power source −1 and the analog ground −1 to the information display panel while the column drive circuit 12 applied the voltage of −V between the panel driving power source −2 and the analog ground −2 to the information display panel. Alternatively, as shown in FIG. 8*b*, the row drive circuit 11 applied the voltage of −V between the panel driving power source −1 and the analog ground −1 to the information display panel while the column drive circuit 12 applied the voltage of +V between the panel driving power source −2 and the analog ground −2 to the information display panel. In this way, the digital circuit and analog circuit (output circuit) were configured as differential drive so that the ground level of the analog circuit could be arbitrarily set within the withstand voltage of the driver IC. As shown in FIGS. 8*a* and 8*b*, each row and column is used with polarity in order to configure a drive circuit capable of handling two times withstand voltage. In other word, it is possible to drive with high withstand voltage by means of an inexpensive drive IC with low withstand voltage. In addition, as shown in FIG. 8*c* "a driver IC capable of outputting only two values including ground level (0V)" is used to configure a drive circuit for driving an information display panel by means of ⅓ bias with little influence of crosstalk.

Figure 9:
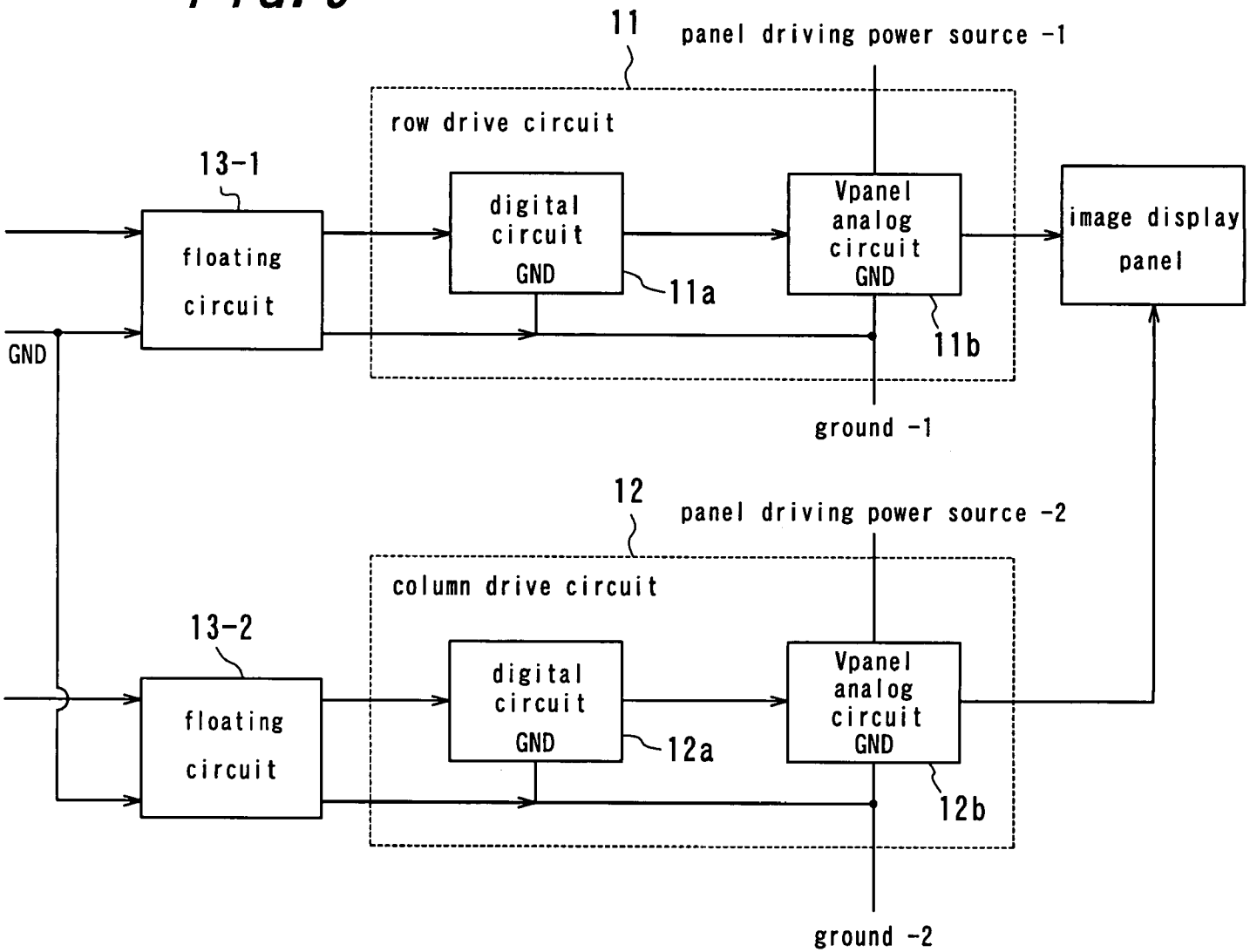
FIG. 9 is a schematic view showing drive circuit of the information display device of the third embodiment according to the invention.
Figure 10:
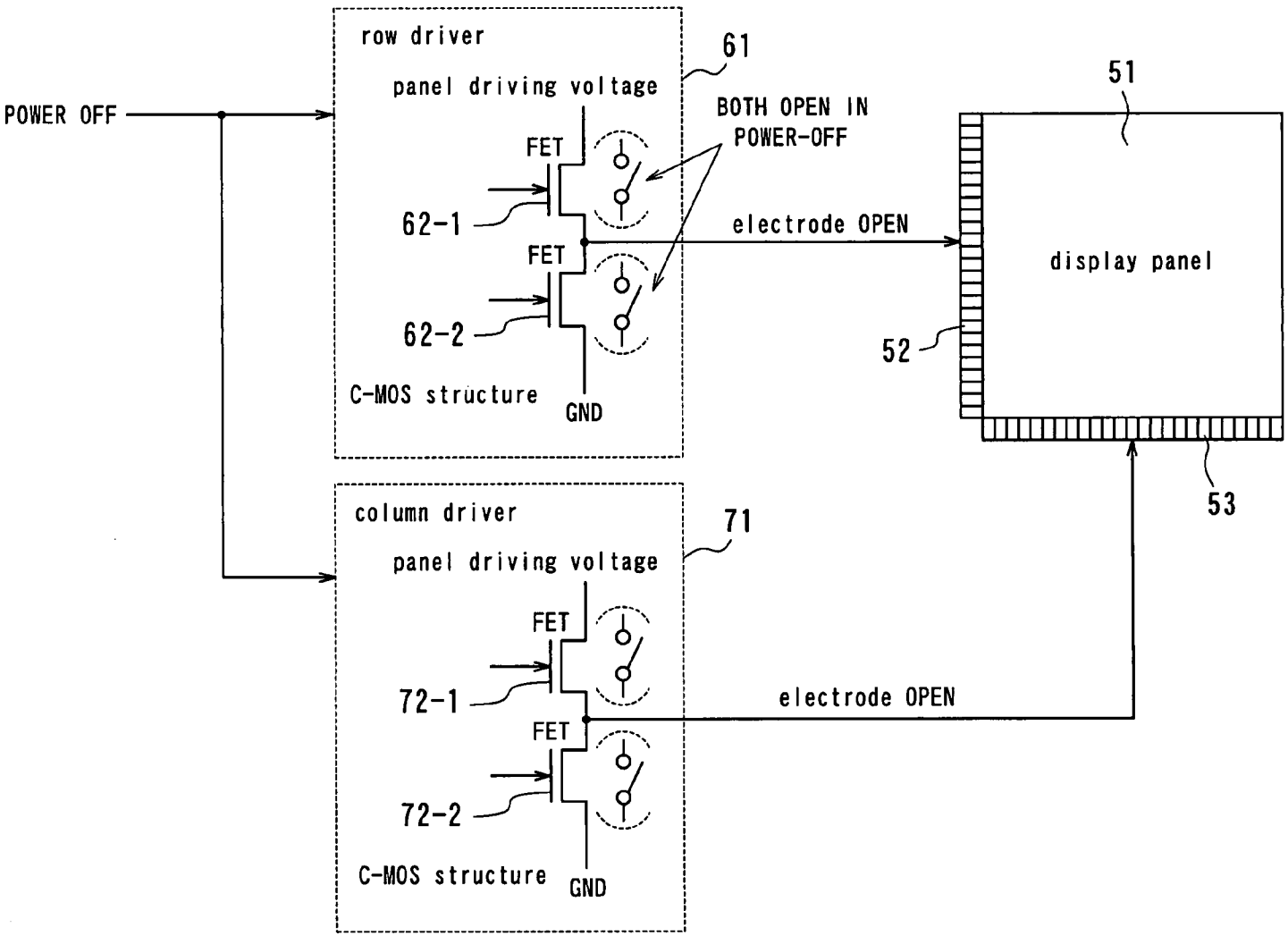
FIG. 10 is a block diagram showing one example of a method for driving a conventional information display device.

According to the information display device of embodiment 2, a drive circuit of the configuration in FIG. 9, in which ground level of the analog circuit could be set independent of ground level of the digital circuit, was used so that the ground level of the analog circuit could be separated from the ground level of the digital circuit and a drive circuit capable of polarity output could be configured by means of a drive IC with C-MOS output stage of unipolarity output. Therefore, "an inexpensive driver IC with general C-MOS output stage structure with low withstand voltage" can be used instead of "an expensive driver IC capable of outputting both driving voltage and intermediate voltage" to achieve cost reduction of the drive circuit and therefore cost reduction of the information display device.

It is preferable that the row and column drive circuits of the drive circuit of the information display device according to the above-mentioned embodiment 2 are configured by drive ICs of triple-well structure for further cost reduction.

Embodiment 3

A drive circuit of the information display device shown in FIG. 9 was produced. In the drive circuit of embodiment 3 floating circuits 13-1 and 13-2, in which GND of the digital and analog circuits were common (connected inside), were added before the row and column drive circuits 11 and 12 of the drive circuit. In this way the floating circuits were provided separately so that the drive circuit could be configured by employing every kinds of drive IC.

According to the information display device of embodiment 3, the drive IC provided with floating circuits was used so that the ground level of the analog circuit could be separated from the ground level of the digital circuit and a drive circuit capable of polarity output could be configured by means of a drive IC with C-MOS output stage of unipolarity output. Therefore, cost reduction of the drive circuit becomes possible, which leads to cost reduction of the information display device.

INDUSTRIALLY APPLICABILITY

The information display device according to the invention is preferably applicable to the display unit for mobile equipment such as notebook personal computers, PDAs, cellular phones, handy terminals and so on; to the electric paper such as electric books, electric newspapers and so on; to the bulletin boards such as signboards, posters, blackboards and so on; to the image display unit for electric calculator, home electric application products, auto supplies and so on; to the card display unit such as point cards, IC cards and so on; and to the display unit for electric advertisements, electric POPs, electric price tags, electric shelf tags, electric musical score, RF-ID device and so on.

The invention claimed is:

1. A method for driving an information display device, wherein display media are sealed between two opposed substrates, at least one of which is transparent, and wherein the display media, to which an electrostatic field is applied, are made to move so as to display information such as an image or the like, characterized in that electrodes of the information display device are connected to predetermined potential in a driving voltage range with low impedance while an information refresh (scan) operation is not performed, wherein a circuit for connecting electrodes to predetermined potential in a driving voltage range with low impedance is configured to function without power supply (in power-off state), and wherein electrodes are connected to GND potential with low impedance so that a body diode at source-to-drain in output stage C-MOS structure of a driver is used and panel driving power source is set to GND level in power-off state.

2. An information display device characterized in that the information display device is driven by means of the method for driving the information display device set forth in claim 1.

3. An information display device characterized in that the particle movement type information display device of passive matrix drive and dynamic drive is driven by means of the method for driving the information display device set forth in claim 1.

* * * * *